US006773103B2

(12) United States Patent
Katoh et al.

(10) Patent No.: US 6,773,103 B2
(45) Date of Patent: Aug. 10, 2004

(54) IMAGE FORMING METHOD AND IMAGE FORMING SYSTEM

(75) Inventors: Takayuki Katoh, Tokyo (JP); Hiroyuki Honda, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/287,068

(22) Filed: Nov. 4, 2002

(65) Prior Publication Data

US 2003/0122915 A1 Jul. 3, 2003

(30) Foreign Application Priority Data

Nov. 21, 2001 (JP) ..... 2001/356698

(51) Int. Cl.[7] ..... B41J 2/01

(52) U.S. Cl. ..... 347/105; 347/102; 347/106; 219/216

(58) Field of Search ..... 347/102, 105, 347/106, 101, 100, 95, 96; 219/216; 101/424.1, 417, 418; 34/202, 210, 218

(56) References Cited

U.S. PATENT DOCUMENTS 6,022,104 A * 2/2000 Lin et al. ..... 347/102

* cited by examiner

*Primary Examiner*—Stephen D. Meier
*Assistant Examiner*—Ly T Tran
(74) *Attorney, Agent, or Firm*—Frishauf, Holtz, Goodman & Chick, P.C.

(57) ABSTRACT

An image forming method comprising the steps of: forming an image by jetting an ink comprising a high-boiling point solvent onto a textile; and removing the high-boiling point solvent from the image-formed textile by drying the fabric under depressurized condition.

9 Claims, 3 Drawing Sheets

IMAGE FORMING METHOD AND IMAGE FORMING SYSTEM

FIELD OF THE INVENTION

The present invention relates to an image forming method and an image forming system to form an image on a textile by ink-jetting, and in particular, the invention relates to an image forming method and an image forming system to obtain high quality prints without producing transfer staining and color staining caused after printing.

RELATED ART

In recent years, an ink-jet textile printing apparatus being superior in small lot and multi-product production has received widespread interest compared to various current types of textile printing apparatus such as flat screen and rotary screen types. In typical ink-jet printing methods, plural colors of ink stored in the apparatus is controlled by digital signals and small ink droplets are ejected onto the textile to directly form an image. Thus, there is no necessity for preparing printing pastes for respective screen plates and colors, thereby leading to a marked decrease in man-hours.

However, methods of ink-jet printing on textiles still exhibit various problems, such as; bleeding after printing, and clogging of the printer head by dried ink, causing transfer staining on portions of the textile, which are to remain blank.

The problem of bleeding after printing can be solved by raising viscosity of the ink. However, if the viscosity of the ink is raised simply, the stability of the jetting of the ink jet head may deteriorate. Consequently, known is a method which prevents ink bleeding by providing a water repellent finishing on the textile as a pretreatment with raising the viscosity only slightly. However, this method often results in ink transfer staining.

It is preferred that ink contains a high boiling solvent to prevent clogging of the head due to the potential of dried ink. However, when the high boiling solvent is used, ink drying is significantly retarded, resulting in unacceptable transfer staining and in color staining. The technology to obtain a sharp image without ink bleeding, by drying with heating to a moisture content of 3 to 30% after printing, is described in Japanese Patent Publication Open to Public Inspection (hereinafter, referred to as JP-A) No. 6-23977. However, this technology is not effective in cases where a high boiling solvent is employed in the ink, producing problems that transfer staining in non-printed portions of the textile still remains.

SUMMARY OF THE INVENTION

Accordingly, an aspect of the present invention is to provide an image forming method for textile utilizing ink-jet printing and an image forming system comprising an image forming apparatus and a drying apparatus to improve the dryness of the printed textiles. The further aspect of the present invention is to solve transfer staining and color staining due to specially formulated ink containing a high boiling solvent.

The foregoing problems can be solved by the following embodiments.

One embodiment of the invention is an image forming method comprising the steps of: forming an image by jetting ink comprising a high-boiling point solvent onto a textile; and removing the high-boiling point solvent from the image-formed textile by drying the textile under depressurized condition.

Another embodiment of the invention is an image forming method comprising the steps of: forming an image by jetting ink comprising a high-boiling point solvent onto a textile; preparing a textile roll by rolling up the image-formed textile with superimposing inserting medium on the textile; and removing the high-boiling point solvent from the image-formed textile by drying the textile roll under a depressurized condition.

Still another embodiment of the invention is an image forming system comprising an ink-jet recording apparatus and a drying apparatus. The ink-jet recording apparatus in the system comprises a recording head to jet an ink comprising a high-boiling point solvent onto a textile. The drying apparatus in the system comprises a chamber to housing therein the image-formed textile, a depressurizing device to depressurize the inside of the chamber, the depressurizing device being connected with the chamber and a trapping device to recovering the high boiling point solvent vaporized in the chamber, the trapping device being positioned between the chamber and the depressurizing device or at the exhausting side of the depressurizing device.

DETAILED DESCRIPTION OF THE INVENTION

The embodiments of the present invention will be detailed below.

Figure 1:
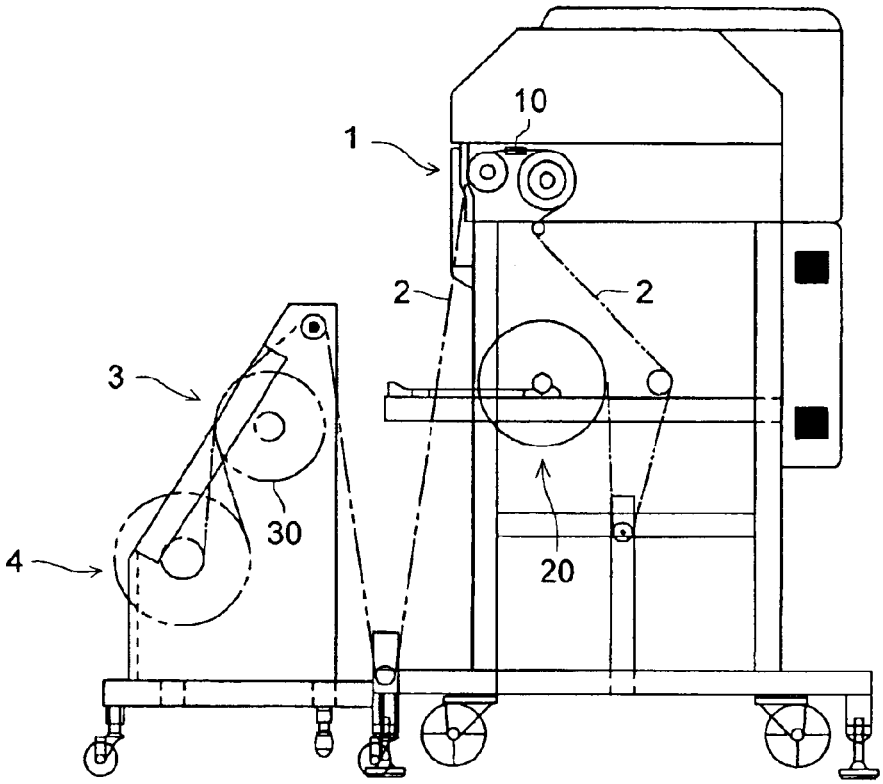
FIG. 1 Side view indicating an example of an ink-jet textile printing apparatus FIG. 2 Sectional view indicating a state of interleaving FIG. 3 Drawing indicating an example of a drying apparatus for ink-jet printing FIG. 4 Drawing indicating another example of a drying apparatus for ink-jet printing FIG. 5 Side view of an ink-jet textile printing apparatus used in the comparative example

FIG. 1 is a side view of an example of an ink-jet recording apparatus. In the figure, "1" is the printing section, "2" is the textile and "20" is a master roll of textile "2"; "3" is an inserting medium supply device to supply inserting medium from an inserting medium roll "30"; "4" is a winding device to wind the textile materials after superimpose the inserting medium on the textile.

Textile "2" is fed from master roll "20", and ink droplets are ejected from head "10" to perform printing. After printed, textile "2" is conveyed to inserting medium supply device "3", and superimposed with the inserting medium, and then wound up by winding device "4".

Figure 2:
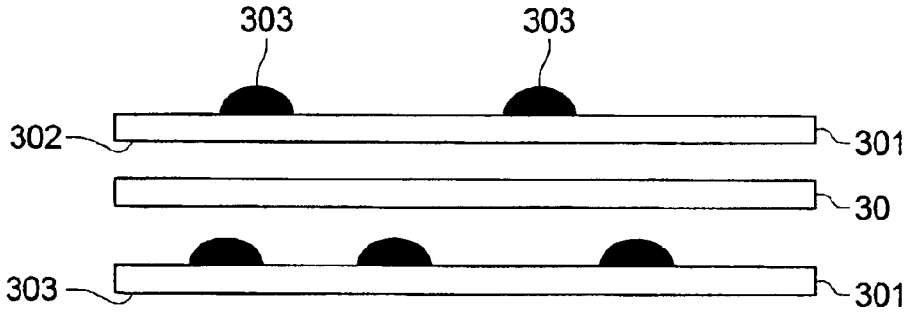

In the present invention, inserting medium represents the conduct to insert a medium "30" for interleaving between print surface "301" and back surface "302" being in contact with "301" as shown in FIG. 2 or represents the medium "30" itself. "303" in FIG. 2 is the printed portion on the textile. This inserting-medium process eliminates necessity for providing the drying apparatus in the printing section "1" or in the vicinity thereof, leading to enhanced operationality and structural apparatus stability.

Examples of medium used for the inserting medium include papers such as blank newspaper, straw paper and tissue paper, non-woven fabric, and basically any material may be used which does not cause the ejected ink adhered to the interleaf to penetrate and reach the backside of the printed surface. Rough non-woven fabric is specifically preferable to achieve the effect of the present invention.

Ink used for ink-jet printing contains a high boiling solvent. In the present invention, the ink preferably contains in an amount of 5 to 60 wt % of a high boiling solvent, and more preferably 20 to 50 wt %.

The high boiling solvent of the present invention refers to one exhibiting more than 150° C. of boiling point under atmospheric pressure. Examples thereof include: glycols such as ethylene glycol, diethylene glycol, triethylene glycol, polyethylene glycol, propanediol, diproplene glycol, buthanediol and hexylene glycol; lower alkyl ethers of polyhydlic alcohols such as glycerin, ethylene glycol monomethyl ether, ethylene glycol monobuthyl ether, diethylene glycol monomethyl ether, and diethylene glycol monoethyl ether; amines such as triethanolamine; and pyrrolidones such as 2-pirrolidone.

In the ink for ink-jet printing used in the present invention, there may be employed one of above high boiling solvents or a mixture of more than two solvents.

Subsequently, the printed textile roll which is printed by using ink containing a high boiling solvent and wound up by an inserting-medium process (hereinafter, also referred to as the printed textile roll), is conveyed to a drying apparatus.

Based on FIG. 3, the preferable embodiments of the present invention will be explained below.

The first embodiment is the drying apparatus for an ink-jet printing in which a heater is not incorporated, and the second is that a heater is incorporated.

Initially, the first embodiment will be described. Main functions of the first embodiment concern the existence of at least a pressure reduction function to reduce pressure and a trap function to trap a distilled high boiling solvent. In the apparatus shown in FIG. 3, evacuator "5" is incorporated to achieve a pressure reduction function, and trapping vessel "6" is provided to fulfill a trapping function. Further, in FIG. 3, "7" is a chamber for a drying apparatus and "40" is the printed textile roll, and "401" is a fixing device to fix printed textile roll "40".

A degree of vacuum of the present invention is the pressure inside the drying apparatus at the time of drying (during removal of the high boiling solvent). The degree of vacuum during drying is preferably in the range of 0.01 through 100 Pa, more preferably 0.01 through 10 Pa. Further, the pressure of the inside of the drying apparatus may be allowed to be relatively high when the pressure reducing time is long, however, the pressure needs to be lower when the time is shorter.

Examples of evacuator "5" include an oil-sealed rotary vacuum pump, a diaphragm type dry vacuum pump and a diffusion pump.

Examples of trapping methods to fulfill a trap function to capture a high boiling solvent include the methods to liquefy by cooling, and to solidify by cooling. Examples of cooling methods include use of ice and dry ice, and furthermore preferable is the use of liquid nitrogen.

Figure 3:
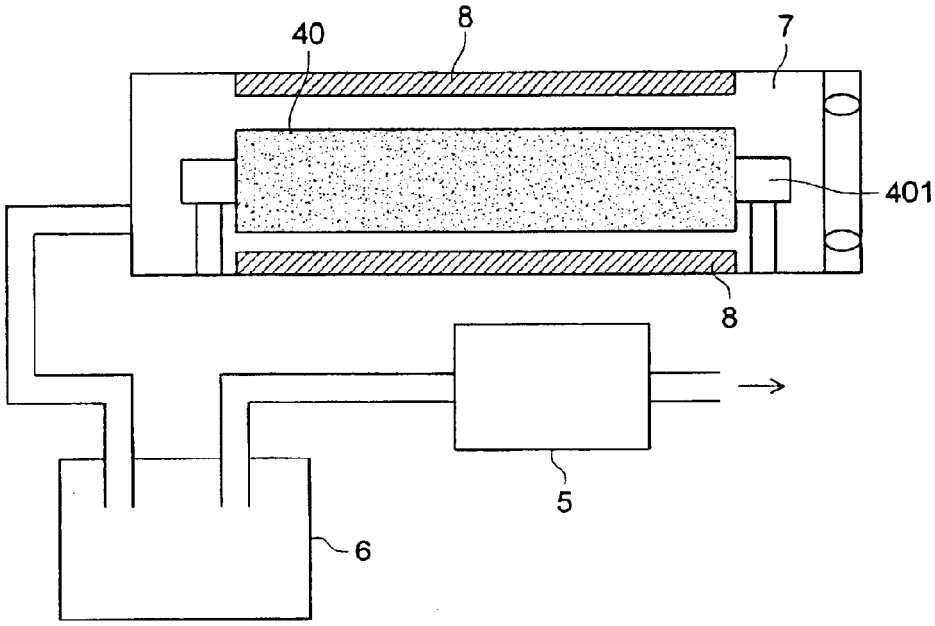

As for a trap function, it is preferable that trapping vessel "6" is connected upstream of evacuator "5" in a vacuum system, as shown in FIG. 3, such as an oil-sealed rotary vacuum pump, or a combination of an oil-sealed rotary pump and a diffusion pump, in which a solvent (such as oil) to vacuumize is in contact with a gas for pressure reducing. This prevents a high boiling solvent from passing through a vacuum pump incorporating evacuator "5", avoiding contamination by oil and resulting in reduction of an oil change frequency and an environment-friendly state.

Figure 4:
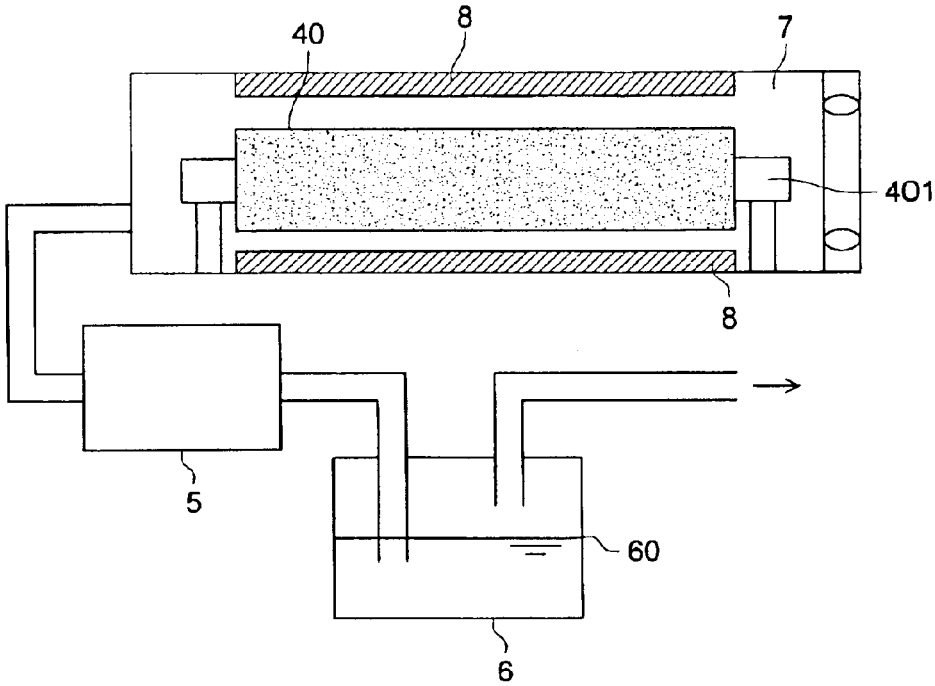

The arrangement shown in FIG. 3 produces better results even when the evacuated gas is not contact the oil, such as the use of a diaphragm type dry vacuum pump, however, trapping vessel "6" can be provided following evacuator "5" (the exhaust side) as shown in FIG. 4. The method to dissolve a solvent in water or other solution "60" filled in trapping vessel "6", to prevent release of the evacuated gases being released into the atmosphere, to adversely affect to the human. Alternatively, the gas can be absorbed into activated charcoal instead of water.

Next, the second embodiment will be explained. This embodiment is one in which that heating device (heater) "8" is installed in chamber "7" as shown in FIGS. 3 and 4. Printed textile roll "40" is warmed by heater "8", and the chamber is evacuated by evacuator "5".

In this embodiment, the necessity of cooling of trapping vessel "6", explained in FIG. 3, can be eliminated. The reason for this is that a temperature of the gas evaporated under reduced pressure is higher than that of trapping vessel, so that the gas is substantially cooled to be liquefied/solidified in the trapping portion.

Examples of the use of an inserting medium 30 have been described in the foregoing embodiments. Alternatively, a high boiling solvent containing ink is discharged, printed onto the textile surface, followed by drying the textile under reduced pressure to remove the high boiling solvent, without using the inserting medium.

EXAMPLES

The present invention will be further described based on the following examples.

Example 1

Nassenger KS-1600 Type II (manufactured by Konica Corp.) was employed as an ink-jet printer. The ink specifically used for Nassenger containing 5% or more glycerine (produced by Konica Corp.) was used. Used inks were 8 colors, including dispersed dyes of yellow, magenta, cyan and black, and light-colored inks thereof. Polyester China crepe was used as textile media, which is dipped in a solution having the following composition as a pretreatment, mangled and then dried.

| | |
|---|---|
| gum sizing agent | 1% |
| cationic polymer | 2% |
| fluorinated water repellent agent | 1% |
| water | 96% |

The pretreated textile was fed to an ink-jet printer and a 1200 mm wide, 500 mm long printed portion of black solid image at a total ink coverage of 50 g/m$^2$ and a 500 mm long non-printed portion were alternated for 40 m, wound up simultaneously with Nassenger KS-1600 Type II (manufactured by Konica Corp.) together with blank newspaper as an inserting medium, and thus the printed textile roll was prepared.

Drying apparatus "A" was made with a 2000 mm length and 700 mm inner diameter chamber, and incorporating a charging door on one side of the chamber. Tightness between the charging door and the chamber was achieved by using an o-ring.

An oil-sealed rotary vacuum pump, at a maximum of 0.04 Pa, was employed as an evacuator, and the outer side of a trapping vessel was cooled by liquid nitrogen. Further, foamed styrene was used to insulate the exterior of the vessel.

These apparatuses were connected with a 10 mm inner diameter stainless steel pipe in the order of the chamber, the trapping vessel and the evacuator. Further, a vacuum gauge was connected to the chamber, and an orifice valve adjuster was provided between the chamber and the trapping vessel.

The printed textile roll was placed into drying apparatus "A", and evacuation was continued for 60 min. with adjusting the orifice valve so that the degree of vacuum was maintained at 0.1 Pa.

Thereafter, the inserting medium was removed and the textile was folded and a load of 5 Kg was applied thereto. Then, the roll was subjected to a color forming treatment by a continuous high temperature and high humidity steamer of 170° C., and thus roll sample A was obtained.

Example 2

A heater was provided around the chamber and a support stand was provided for the printed textile roll in drying apparatus "A", to prepare drying apparatus "B".

Another printed textile roll was prepared in the same way as in Example 1, and placed into drying apparatus "B". The heater was adjusted to a temperature of 60° C. with bringing a thermo couple into contacted with the printed textile roll and the roll was allowed to stand for about 20 min.

Next, the chamber was evacuated for 60 min by adjusting the orifice valve to make the degree of vacuum 0.1 Pa.

After removing the inserting medium, the textile was folded and a load of 5 Kg was applied thereto, and the roll was subjected to a color forming treatment by a continuous high temperature and high humidity steamer of 170° C., and thus roll sample B was obtained. In addition, water of less than 10° C. instead of liquid nitrogen was used in the trapping vessel.

Example 3

The evacuator in drying apparatus "A" was replaced with a diaphragm type dry vacuum pump, and a chamber, an evacuator and a trapping vessel were connected in the above order. An orifice valve was installed between the chamber and the evacuator, and thus drying apparatus "C" was prepared.

The printed textile roll was prepared in the same way as in Example 1, and placed into drying apparatus "C", after which the chamber was evacuated for about 180 min so that the degree of vacuum was to be 100 Pa.

An exhaust pipe was placed into water as shown in FIG. 4 so as to dissolve a solvent into water.

After that, the inserting medium was removed and the textile was folded and a load of 5 Kg was applied thereto, and the roll was subjected to a color forming treatment by a continuous high temperature and high humidity steamer of 170° C., and thus roll sample C was obtained.

Example 4

The ink specifically used for Nassenger (produced by Konica Corp.) was used. Used inks were 8 colors, including reactive inks as typical dye inks of yellow, magenta, cyan and black, and light-colored inks thereof.

A plain woven cotton fabric was used as textile media, which was dipped in a solution having the following composition as pretreatment, mangled and then dried.

| | |
|---|---|
| high viscosity sodium alginate | 1.0% |
| sodium hydrogencarbonate | 0.5% |
| fluoro water repellent agent | 1.0% |
| urea | 0.5% |
| water | 97.0% |

Pretreated textile was fed into the ink-jet apparatus, and a 1200 mm width 500 mm length of a printed portion of a black solid image, at a total ink coverage of 50 g/m$^2$ and a 500 mm length of a non-printed portion were alternated for 40 m, wound up simultaneously with Nassenger KS-1600 Type II (manufactured by Konica Corp.) together with blank newspaper as an inserting medium, and thus the printed textile roll was prepared.

Drying was accomplished in the same way as in Example 1, after which the inserting medium was removed, and the textile was folded and a load of 5 Kg was applied thereto. The roll was then subjected to a color forming treatment by a continuous normal pressure wet steamer at 105° C., and thus roll sample D was produced.

Example 5

The printed textile roll of Example 4 was dried in the same way as in Example 2, and folded and a load of 5 Kg was applied thereto after removing the inserting medium. Thus, roll sample E was produced after color forming treatment at 105° C. by a continuous normal pressure wet steamer.

Example 6

The printed textile roll of Example 4 was dried in the same way as in Example 3, and folded and a load of 5 Kg was applied thereto after removing the inserting medium. Thus, roll sample F was obtained after color-development by a continuous type normal pressure wet steamer of 105° C.

Comparative Example 1

As the comparative example of Examples 1 through 3, the roll samples of comparative sample A were obtained in a conventional drying manner described below instead of reduced-pressure drying.

Figure 5:
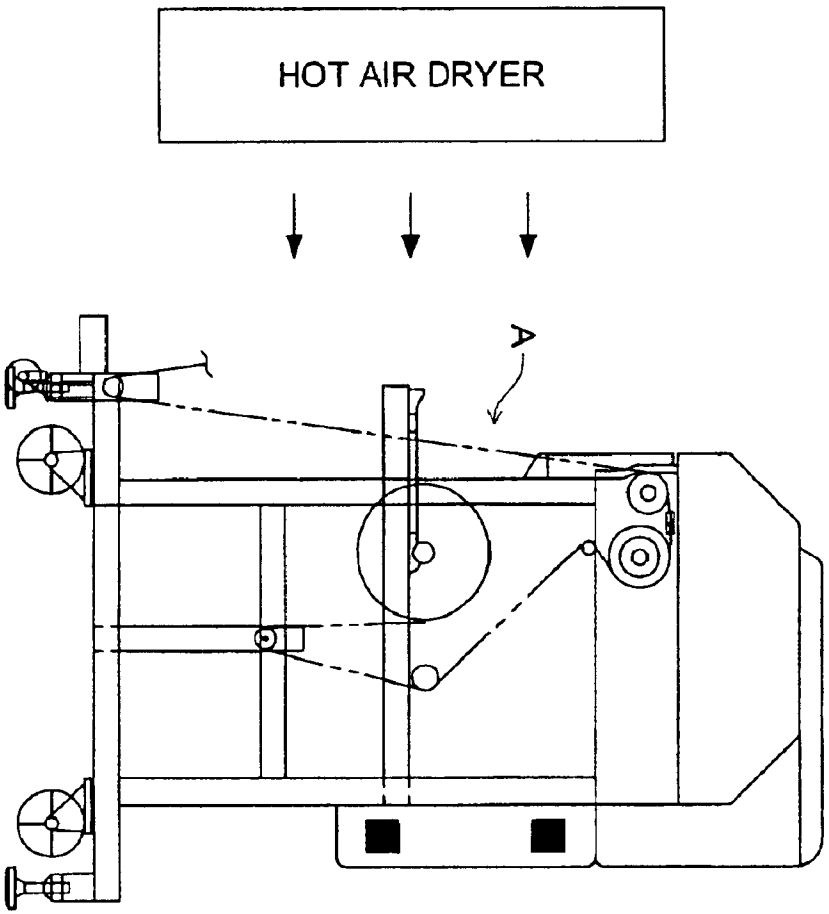

The drying method is illustrated in FIG. 5, using a hot air dryer instead of the inserting medium supply apparatus and the winding apparatus, illustrated in FIG. 1. Drying of the printed textile was conducted at a temperature of 40° C., 120° C. and 180° C. (in the portion designated as A in FIG. 5).

Comparative Example 2

As the comparative example of Examples 4 through 6, the roll samples of comparative sample B were obtained in the conventional drying manner instead of the reduced-pressure drying in the same way as in above Comparative Example 1.

(Evaluation)

Evaluation was made with respect to transfer staining onto the backside surface and transfer staining onto the surface of the print using Colorimeter SP62 (manufactured by X-Rite, Inc.) and visual check based on the criteria described below. Also, evaluation as to smoke and odor was performed. The evaluated results are shown in Table 1.

<Criteria of Evaluation>

<<Measuring Method with a Colorimeter>>

Colorimetric values of the textile itself before printing ($L_1^*$, $a_1^*$, $b_1^*$), and non-printed portion of the textile after printing ($L_2^*$, $a_2^*$, $b_2^*$), were compared and indicated as δE. δE can be determined by the following Equation 1.

$$\Delta E = \sqrt{(L_1^* - L_2^*)^2 + (a_1^* - a_2^*)^2 + (b_1^* - b_2^*)^2} \quad \text{Equation 1}$$

<<Evaluation by Visual Checking>>

A: no stains were noted

B: slight discoloring was noted apparent stains were observed

<<Overall Evaluation>>

In cases of δE≦2.0, most people could not recognize an abnormal coloring. Therefore, the overall evaluation was "superior" when δE≦2.0 and at the same time the visual check was B or A, while other cases were determined "inferior". In the case when smoke or odor was noted, the determination was also "inferior", considered from the viewpoint of enviornmental issues.

TABLE 1

| | | Print Surface | | Backside Surface | | Other | |
|---|---|---|---|---|---|---|---|
| | | Visual Check | Colorimetry | Visual Check | Colorimetry | Smoke/Odor | Overall Evaluation |
| Example 1 | | A | 1.5 | B | 1.8 | No | Superior |
| Example 2 | | A | 1.2 | A | 1.7 | No | Superior |
| Example 3 | | B | 1.8 | B | 1.7 | No | Superior |
| Example 4 | | A | 1.0 | A | 1.0 | No | Superior |
| Example 5 | | A | 0.8 | A | 0.9 | No | Superior |
| Example 6 | | A | 1.1 | A | 1.4 | No | Superior |
| Comp. 1 | 40° C. | C | 5.4 | C | 4.8 | No | Inferior |
| | 100° C. | B | 2.0 | B | 1.9 | Yes | Inferior |
| | 180° C. | A | 1.4 | A | 1.2 | Yes | Inferior |
| Comp. 2 | 40° C. | C | 3.3 | C | 4.4 | No | Inferior |
| | 100° C. | A | 1.8 | B | 1.7 | Yes | Inferior |
| | 180° C. | A | 1.5 | A | 1.5 | Yes | Inferior |

Comp.: Comparative Example

Effect of the Invention

Based on the present invention, as explained above, insufficient drying, in regard to ink-jet printing using high boiling solvent in ink has been resolved, and an excellent stainless image is obtained at a high yielding ratio, resulting in a high quality printing process.

What is claimed is:

1. An image forming method comprising the steps of:

forming an image by jetting an ink comprising a high-boiling point solvent onto a textile;

removing the high-boiling point solvent from the image-formed textile by drying the fabric under depressurized condition; and recovering the removed high-boiling solvent by cooling.

2. An image forming method comprising the step of:

forming an image by jetting an ink comprising a high-boiling point solvent onto a textile;

preparing a textile roll by rolling up the image-formed textile with superimposing inserting paper on the image-formed textile; and removing the hign-boiling point solvent from the image-formed textile by drying the textile roll under a depressurized condition.

3. The image forming method of claim 1, wherein the degree of vacuum of the depressurized condition is from 0.01 to 100 Pa.

4. The image forming method of claim 2, wherein the degree of vacuum of the depressurized condition is from 0.01 to 100 Pa.

5. The image forming method of claim 1, wherein the image-formed textile is heated in the removing step.

6. The image forming method of claim 2, wherein the image-formed textile is heated in the removing step.

7. The image forming method of claim 2, wherein the image forming method further comprises recovering the removed high boiling point solvent by cooling.

8. An image forming system comprising an ink-jet recording apparatus and a drying apparatus, the ink-jet recording apparatus comprising:

a recording head to jet an ink comprising a high-boiling point solvent onto a textile, the drying apparatus comprising:

a chamber to housing therein the image-formed textile;

a depressurizing device to depressurize the inside of the chamber, the depressurizing device being connected with the chamber; and a trapping device to recover the high-boiling point solvent vaporized in the chamber, the trapping device being positioned between the chamber and the depressurizing device or at the exhausting side of the depressurizing device.

9. The image forming system of claim 8, wherein the drying apparatus further comprises a heating device to heat the inside of the chamber.

* * * * *